United States Patent [19]

Moseman, Jr. et al.

[11] 3,946,229

[45] Mar. 23, 1976

[54] GAIN CONTROL FOR A QUADRUPOLE MASS SPECTROMETER

[75] Inventors: Paul W. Moseman, Jr.; David Passeri, both of Davenport, Iowa; John P. Carrico, Southfield, Mich.

[73] Assignee: The Bendix Corporation, South Bend, Ind.

[22] Filed: Mar. 29, 1974

[21] Appl. No.: 456,325

[52] U.S. Cl. ..... 250/292; 250/300

[51] Int. Cl.[2] ..... H01J 39/34

[58] Field of Search ..... 250/292, 281, 282, 283, 250/299, 300

[56] References Cited

UNITED STATES PATENTS

| | | | |
|---|---|---|---|
| 3,510,647 | 5/1970 | Wood | 250/281 |
| 3,641,340 | 2/1972 | Van Der Grinten | 250/292 |
| 3,648,047 | 3/1972 | Bushman | 250/300 |
| 3,823,315 | 7/1974 | Mosharrafa | 250/292 |

*Primary Examiner*—Craig E. Church
*Attorney, Agent, or Firm*—Leo H. McCormick, Jr.; William N. Antonis

[57] ABSTRACT

A quadrupole mass spectrometer gain control system for continually analyzing a gas mixture with accuracy. A quadrupole mass filter is located in the system to receive the gas mixture output from an ionization source. The quadrupole mass filter is operated in such a manner as to sequentially select the mass channel, detect mass peak amplitudes, and compensate for mass dependencies of individual channels through which an output signal representative of the percentages of an individual gas in the mixture is transmitted to a display. To compensate for system gain variations occurring in the ionization source, mass filter, ion detector, and detector preamplification function, a system gain control is provided in which the sum of the constituent gas amplitudes is compared with a 100% amplitude reference, and the error signal used to control the system gain.

3 Claims, 1 Drawing Figure

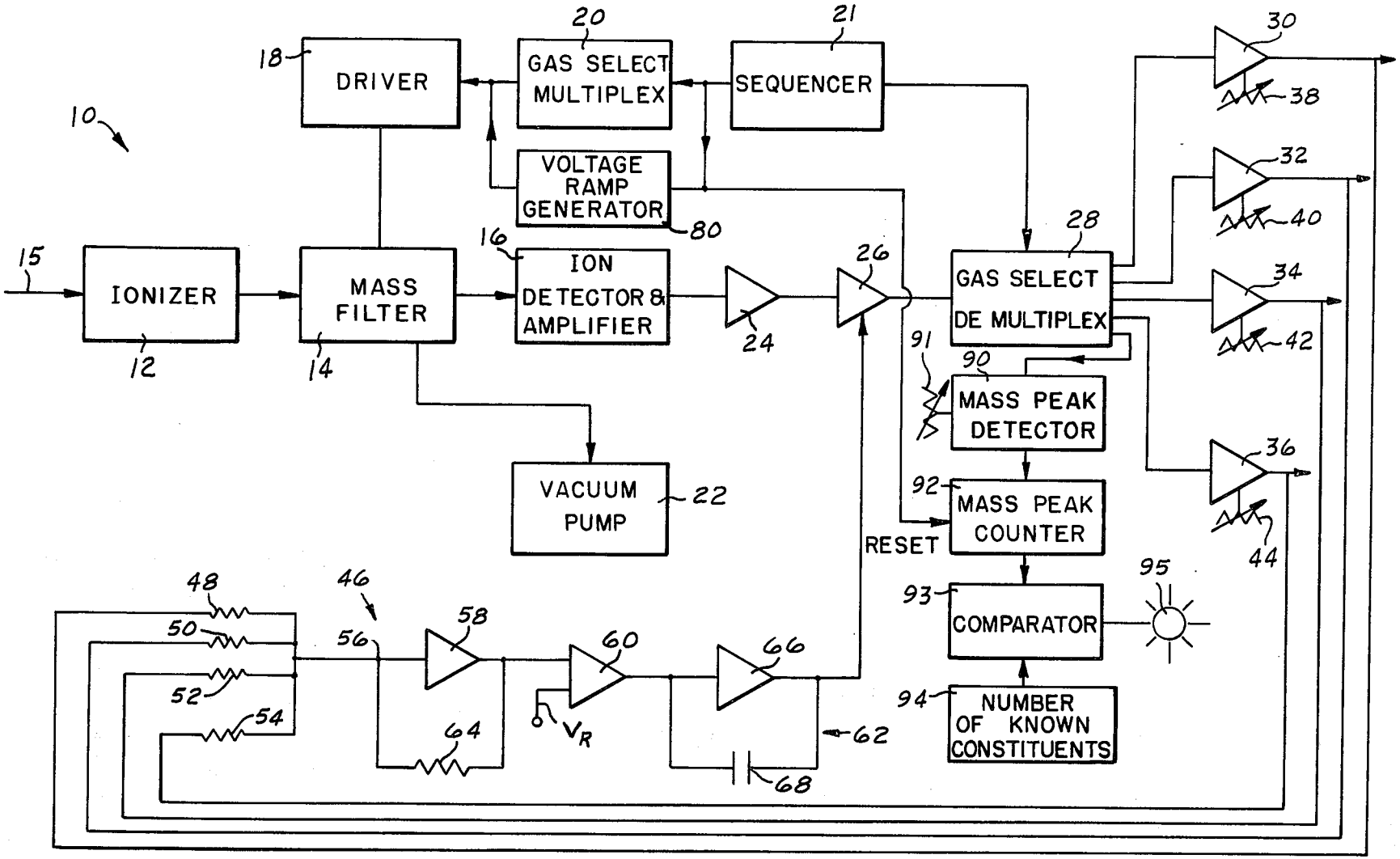
GAS SELECT MULTIPLEX
MASS PEAK DETECTOR
MASS PEAK COUNTER
COMPARATOR
NUMBER OF KNOWN CONSTITUENTS
SEQUENCER
GAS SELECT MULTIPLEX
VOLTAGE RAMP GENERATOR
ION DETECTOR & AMPLIFIER
VACUUM PUMP
DRIVER
MASS FILTER
IONIZER
RESET
$V_R$
10
12
14
15
16
18
20
21
22
24
26
28
30
32
34
36
38
40
42
44
46
48
50
52
54
56
58
60
62
64
66
68
80
90
91
92
93
94
95

GAIN CONTROL FOR A QUADRUPOLE MASS SPECTROMETER

BACKGROUND OF THE INVENTION

The compositional analyses of blood gases and respiratory gases can provide vital information relating to the operational parameters of the several subsystems contributing to the pulmonary function, to the response to anesthetics, to therapy, and to the environment, is taught in U.S. application Ser. No. 318,152, filed Dec. 26, 1972. As disclosed in U.S. Pat. No. 3,712,111 these gases can be continually analyzed through the use of a mass spectrometer in a laboratory. Mass spectrometers are complex machines traditionally found in research laboratories where technical operator skills are readily available and frequent recalibration is not a handicap. The contribution of mass spectrometry to general pulmonary health will be enhanced if reliable operation can be achieved in a clinical environment to provide information in a continuous or on-line breath-by-breath analyses with high long-term accuracy. On-line analyses can be performed by introducing a micro-sample of the respiratory gas into the spectrometer through a controlled leak and continuously pumping to maintain the required working vacuum. This type of operation degrades the system sensitivity by causing irreversible effects in the gas ionization process, deposition of ions on the mass filter insulators, mechanical abrasion of the impact area in the ion detector, and gradual loss of detector gain. Frequent recalibration with known mixtures has been an operational necessity with systems of the prior art. In an effort to reduce the need for calibration and assure continual quality control, many gain control mechanisms have been suggested. An obvious method of gain control in a mass spectrometer is to vary the ion detector gain by varying the voltage applied to the input end of the detector. However, this introduces a mass dependent effect due to the field between the spectrometer and the detector. This is produced by the fringing field of the spectrometer and the acceleration field of the detector. The former changes with mass because of the scanning, and the latter changes with the detector gain since the voltage at the detector input is adjustable. However, variation of voltage at the exit end of the ion detector introduces additional operational difficulties such as, sample consistency, unknown temperature and pressure effects on gas, etc. Another method of gain control is to use the familiar all-ion peak of a quadrupole spectrometer, i.e., ($V_{dc} = 0$) to understand its limitation.

Consider an n-component system of gases. The corresponding signals are:

$$\mathrm{Sig}_i = \alpha\, G\, \gamma_i\, C_i \qquad i = 1, 2, \ldots, n \tag{1}$$

where the subscript denotes the species, G is the detector gain, $\alpha$ is a constant containing the ion source parameters (electron current and source dimensions), $C_i$ is the concentration, and $\gamma_i$ involves the ionization efficiency, gas transport, transmission efficiency, detection efficiency, and pump speed.

Also, there is the constraint $$\sum_{i=1}^{n} C_i = 1 \tag{2}$$

Assuming that $\alpha$ and the $\gamma_i$'s are known, equations (1) and (2) constitute a set of $n + 1$ linearly independent equations in the $n + 1$ unknown G and $C_i$'s. Thus, this set can be solved uniquely. In particular, the expression for the gain is:

$$G = \frac{1}{\alpha} \sum_{i=1}^{n} \left(\frac{\mathrm{Sig}_i}{\gamma_i}\right) \tag{3}$$

Returning Equation (1) to explain inherent limitations with an all-ion peak system, the all-ion peak control signal is calculated from the following:

$$\mathrm{Sig}_{AIP} = \sum_{i=1}^{n} \mathrm{Sig}_i = \alpha_G \sum_{i=1}^{n} \gamma_i\, C_i \tag{4}$$

If this all-ion peak signal is used to control the detector gain, then $\mathrm{Sig}_{AIP}$ has to be a constant, i.e., $$\mathrm{Sig}_{AIP} = \mathrm{K} \qquad 5.$$

Substituting this into equation (4) the expression for the gain is as follows:

$$G = \frac{K}{\alpha \sum_{i=1}^{n} (\alpha_i\, C_i)} \tag{6}$$

and the detector signal for the $i^{th}$ constituent will be $$\mathrm{Sig} = \gamma_i\, C_i \frac{K}{\sum_{i=1}^{n} \gamma_i\, C_i} \tag{7}$$

From equation (7) it can be seen that the signal for a given molecular constituent will depend on the concentrations of the other gases present. Thus, it is not possible to use the AIP as the control signal.

Another means of stabilizing the output from the spectrometer is to use a tracer gas of "standard concentration" ($C_j$) giving an output ($\mathrm{Sig}_j$) which is mixed with the sample to be analyzed. This approach is rendered impracticable by the difficulty of maintaining a "standard concentration" of the tracer gas which is independent of temperature, pressure and time.

Another method of gain control is as follows. An output signal corresponding to the $j^{th}$ molecular species present in the ion source would be represented as such:

$$\mathrm{Sig}_j = \mathrm{G}\, \gamma_j\, \mathrm{C}_j \qquad 8$$

where:

$\gamma_j$ represents system parameters dependent on the type of gas detected, and $C_j$ is the concentration. The ratio of signals for different molecular species, say $i$ and $j$, produces the following relationship:

$$\frac{\mathrm{Sig}_i}{\mathrm{Sig}_j} = \frac{\gamma_i\, C_i}{\gamma_j\, C_j} \tag{9}$$

Note that this ratio is independent of the signal gain, however, it is assumed $\gamma$, does not depend on the concentration. From Equation (9), the ratio will change with time if the concentrations change. This behavior is used in an automatic gain system in which the signal control for a given molecular species is used as the control signal, and the signal corresponding to the ratio (Equation 9) of the signals for two given species serves to abort the control change if the ratio changes. Thus, gain adjustments are made only during those periods of time in which the ratio (Equation 9) is a constant. A condition which occurs only when the concentrations remain constant. This method is impractical since the intensity of the signal is directly controlled by the stability of the contraction.

SUMMARY OF THE INVENTION

We have devised a means for providing a spectrometer with an automatic gain control to maintain an accurate control for the system gain resulting from conditional changes in a gas which is to be analyzed. A feedback from the output of the individual component signals generated in the spectrometer is relayed to the automatic gain control. The automatic gain control will sum the outputs to assure that the components of the analyzed gas equal 100% by evaluation in a comparator means. Any error signal developed in the comparator means is transmitted to an integrator where a corrective signal is developed to control the output of the spectrometer. If an unknown molecular species (which is not being monitored as one of the component parts of analyzed mixture) is introduced into the sample, the displayed percentages of the monitored constituents will be erroneous. However, we have provided a means to alert the operator that such an error is in the system.

It is therefore an object of this invention to provide a spectrometer with an automatic gain control to accurately analyze a gas mixture.

It is another object of this invention to provide an automatic gain control with a series of component signals the sum of which is compared with a reference signal to develop a corrective signal for modifying the component signals so that this sum equals the reference signal. It is a further object of this invention to provide a means for alerting the mass spectrometer operator of the advent of a non-monitored gas species of sufficient concentration to cause errors in the displayed percentage of the monitored constituents.

BRIEF DESCRIPTION OF THE DRAWING

The drawing is a diagrammatic illustration of the components of an automatic gain control for a spectrometer.

DETAILED DESCRIPTION OF THE PREFERRED EMBODIMENT

In the drawing, a quadrupole mass spectrometer 10 for continuous quantitative analysis of mixtures of N principle constituents is shown with an automatic gain control means 46. The mass spectrometer 10 consists of a gas ionizer 12 which produces ions from gas molecules. These ions are injected into a mass filter 14. The filter 14 has four rods of such shape and spacing connected to a source of electric voltage to develop and shape a linear electric field pattern through which the ions migrate. A portion of the original ions will arrive at an ion detector-amplifier 16 where an electrical signal, proportional to the rate of ion arrivals, is generated.

The electric field which the ions encounter in mass filter 14 is controlled in such a manner by a quadrupole driver 18 and a gas selection multiplexer 20 that the migrating ions will be subjected to tins-dependent transverse forces and experience periodic transverse accelerations. The amplitude of transverse ion motion is made stable for any given mass to charge ratio ($m/e$) by appropriately adjusting the field parameters $V_{ac}$, $V_{dc}$, and $\omega$ in the mass filter 14. The transverse oscillations will grow without limit for ions having other than the selected $m/e$ ratio. These ions are not transmitted through the quadrupole filter 14 and hence are not received at the ion detector 16. A vacuum pump 22 maintains a satisfactory pressure within the mass filter 14 and thus balances the gas sample being continuously vented through conduit 15 into the ionization section 12. A preamplifier 24 converts the minute electron current signals provided by the ion detector-amplifier 16 into a voltage which is transmitted through a gain control amplifier 26 to produce an output signal. A gas selection demultiplexer 28 directs the output signal which is sequentially proportional to the concentrations of the various constituents of the gas mixture being sampled into parallel channels or circuits 30, 32, 34 and 36 for Gas No. 1, Gas No. 2, Gas No. 3 and Gas No. N. Each gas channel or circuit 30, 32, 34 and 36 has a corresponding gain adjustment range(38, 40, 42 and 44) sufficient to compensate for ionization, gas transport, transmission and detection efficiencies for the constituent gases of the mixture being analyzed. The gain adjustments (38, 40, 42 and 44) are made with a calibration standard mixture and are not changed until recalibration is necessary.

The output communicated to each channel or circuit 30, 32, 34 and 36 is transmitted to corresponding indicator dials where an operator can visually read or a recorder will make a record of the percentage of the individual gas in the mixture.

Through the mass spectrometer 10 described thus far, a quantitative analysis of a gas mixture can be made. However, it is an open loop system and the various processes involved in ionization, filtering, detection and amplification have varying time, pressure, and temperature dependencies. The result is a degradation in measurement accuracy commencing with the end of the calibration procedure. The open loop system is converted into a closed loop system by the addition of an automatic gain control means 46. The automatic gain control means 46 has a series of parallel resistors 48, 50, 52 and 54 connected to correspondingly sample the output from each channel going to the indicators. A current proportional to the concentration of each constituent gas is presented through a summing junction 56 of summing amplifier 58. The output of summing amplifier 58, as modified by gain setting resistor 64, will be proportional to the total of constituent gas amplitudes and is compared with a reference voltage $V_r$ representing 100% amplitude of the constituent gas sum in a comparator 60 to produce an error signal. This error signal, generated in the comparator 60 which is representative of total degradation in system gain, is transmitted to an integrator 62. The integrator 62 includes a ramp amplifier 66 which is parallel to a capacitor 68. The output from the integrator 62 is used to control the gain of an amplifier 26 in such a manner to return the summation of constituent gas amplitude signals to the equivalence of 100%. Periodically the sequencer 21 substitutes a voltage ramp generator 80 for the gas select multiplex 20 and thereby causes the mass filter to scan the entire mass range of the instrument. During this scanning period a mass peak detector 90 is connected to the output of ion detector 16 preamp 24 through the gain controlled amplifier 26. For each mass peak above minimum value set by threshold control 91 an output pulse is sent to the mass peak counter 92. The number of mass peaks recorded by the mass peak counter 92 is balanced in a comparator 93 with the criterion being number of known constituent gases 94. If the number of detected mass peaks exceeds the number of known constituents, an alarm 95 alerts the operator of the condition.

MODE OF OPERATION OF THE PREFERRED EMBODIMENT

A sample of the gas mixture under investigation is continually transmitted through conduit 15 into the mass filter 14. Sequencer or timer 21 will send an appropriate timing signal to both the gas select multiplex 20 and the gas select demultiplex 28. The output from the gas select multiplex will switch the driver 18 into a first mode of operation wherein the electric field created in the mass filter will allow only one type of ion to pass into the detector and amplifier 16. At the same time, the timing signal will operate the gas select demultiplex 28 in a corresponding first mode wherein the voltage signal from the amplifiers 24 and 26 is directed to the appropriate channel or circuit, i.e., 30. The voltage signal presented to the channel 30 is relayed to a voltmeter or other appropriate indicator for indicating the percentage of the one type of ion in the gas sample at this period of time. A portion of the voltage signal is relayed through resistor 48 to the summing junction 56.

The sequencer 21 will sequentially provide an operational signal to the gas select multiplex 20 and gas select demultiplex 28 to sequentially scan the Gas No. 2, Gas No. 3, . . . , and Gas No. N in the same manner as described with Gas No. 1 above. The timing signal for each gas in the mixture will vary but normally for most samples about 30 scans will occur in a second for each gas to essentially present a continuous and uninterrupted output from the channels or circuits 30, 32, 34 and 36. This will permit the output voltage from the summing junction 56 to supply the comparator 60 with a summed voltage which is measured against the reference voltage $V_r$ to create the error signal for operating the integrator 62. The error signal will be modified in the integrator 62 to automatically create a gain control signal which will regulate the operation of the gain control amplifier in such a manner that the sum of the component part voltage is equated with the reference voltage.

If, during the periodic scan of the entire mass range of the spectrometer, the number of mass peaks exceeds the minimum number previously selected by the instrument operator, an alert signal 95 is provided.

We claim:

1. In a quadrupole mass spectrometer wherein a gaseous mixture is sequentially scanned to obtain a measurement of the relative abundance of each component thereof, control means for automatically compensating for variations in ionization, gas transportation and detection efficiencies of said gaseous mixture to continually obtain an accurate analyzation, said control means comprising:

first amplifier means for generating an ion detection signal representative of each component in said gaseous mixture as established through the scanning of the gaseous mixture;

demultiplex means for converting said ion detection signal for each component into a corresponding output signal in synchronization with the sequential scan of the gaseous mixture;

channel means for communicating said output signal to an indicator means to inform an operator of said relationship of each component in said gaseous mixture;

adjustment means associated with said channel means for modifying the output signal of a known gas sample presented to an ionizer to calibrate said indicator means;

first resistor means connected to said channel means for reducing each of said output signals to produce a proportional output signal corresponding to the concentration of each gas in the gaseous mixture;

junction means connected to said first resistor means for combining said proportional output signal of each of said components to produce a component signal;

second amplifier means connected to said junction means for increasing the amplitude of said component signal;

second resistor means associated with said second amplifier means for controlling the gain of the component signal;

comparator means connected to said second amplifier means for comparing said component signal with a reference signal to establish an error signal; and integrator means having a ramp amplifier and a capacitor means responsive to said error signal for establishing a gain signal for proportionally modifying each of said ion detection signals from said first amplifier means in a manner such that the component signal is brought into equalization with said reference signal in a series of uniform steps.

2. In the quadrupole mass spectrometer, as recited in claim 1, wherein said control means includes:

mass peak detecting and counting means for periodically monitoring the input gas mixture for changes in constituency to produce an evaluation signal representative thereof.

3. In the quadrupole mass spectrometer, as recited in claim 2, wherein said control means further includes:

means for comparing the evaluation signal with a reference signal to produce an alarm signal and thereby inform an operator of the operational parameter.

* * * * *